US007594434B2

(12) United States Patent
Dagenais et al.

(10) Patent No.: US 7,594,434 B2
(45) Date of Patent: Sep. 29, 2009

(54) DOWNHOLE TOOL SYSTEM AND METHOD FOR USE OF SAME

(75) Inventors: Pete C. Dagenais, The Colony, TX (US); Orlando de Jesus, Dallas, TX (US); Liping Li, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 10 days.

(21) Appl. No.: 12/017,483

(22) Filed: Jan. 22, 2008

(65) Prior Publication Data

US 2008/0128126 A1 Jun. 5, 2008

Related U.S. Application Data

(63) Continuation of application No. 10/841,780, filed on May 7, 2004, now abandoned.

(51) Int. Cl.
*E21B 47/00* (2006.01)

(52) U.S. Cl. ..... 73/152.54; 73/152.28; 73/152.46; 73/152.53; 73/86; 324/71.2

(58) Field of Classification Search ..... 73/152.28, 73/152.54, 152.45, 152.46, 86; 324/71.2
See application file for complete search history.

(56) References Cited

U.S. PATENT DOCUMENTS 4,655,077 A 4/1987 Purvis et al.
4,720,626 A 1/1988 Nishikawa et al.
5,562,787 A 10/1996 Koch et al.
5,698,631 A 12/1997 Sigworth et al.
5,804,713 A * 9/1998 Kluth ..... 73/152.01
5,963,134 A 10/1999 Bowers et al.
6,144,301 A 11/2000 Frieden
6,206,282 B1 3/2001 Hayes, Sr. et al.
6,307,517 B1 10/2001 Lee
6,324,904 B1 * 12/2001 Ishikawa et al. ..... 73/152.03
6,333,699 B1 12/2001 Zierolf
6,333,700 B1 12/2001 Thomeer et al.
6,421,013 B1 7/2002 Chung
6,426,917 B1 7/2002 Tabanou et al.
6,443,228 B1 * 9/2002 Aronstam et al. ..... 166/250.11

(Continued)

OTHER PUBLICATIONS

"EmbedSense Wireless Sensor"; MicroStrain; http://www.microstrain.com/embed-sense.aspx; 3 pages. (Undated but admitted prior art).

(Continued)

*Primary Examiner*—Hezron Williams
*Assistant Examiner*—Rachel Black
(74) *Attorney, Agent, or Firm*—Lawrence R. Youst

(57) ABSTRACT

A downhole tool system includes a downhole tool operably positionable within a wellbore and a sensor positioned within the downhole tool. The sensor has a first mode and a second mode. In the first mode, the sensor is responsive to RF interrogation. In the second mode, the sensor is not responsive to RF interrogation. The sensor is operable to transition from the first mode to the second mode upon the occurrence of a predetermined level of erosion of the downhole tool proximate the sensor. A detector is operably positionable relative to the downhole tool and in communicative proximity to the sensor. The detector interrogates the sensor to determine whether the predetermined level of erosion has occurred.

20 Claims, 5 Drawing Sheets

U.S. PATENT DOCUMENTS

| | | | | |
|---|---|---|---|---|
| 6,483,427 | B1 | 11/2002 | Werb | |
| 6,496,806 | B1 | 12/2002 | Horwitz et al. | |
| 6,501,382 | B1 | 12/2002 | Rehfus et al. | |
| 6,535,175 | B2 | 3/2003 | Brady et al. | |
| 6,540,022 | B2 | 4/2003 | Dusterhoft et al. | |
| 6,543,280 | B2 | 4/2003 | Duhon | |
| 6,563,417 | B1 | 5/2003 | Shaw | |
| 6,581,689 | B2 | 6/2003 | Hailey, Jr. | |
| 6,597,175 | B1 | 7/2003 | Brisco | |
| 6,600,418 | B2 | 7/2003 | Francis et al. | |
| 6,604,063 | B2 | 8/2003 | Denny et al. | |
| 6,617,963 | B1 | 9/2003 | Watters et al. | |
| 6,745,833 | B2 * | 6/2004 | Aronstam et al. | 166/250.11 |
| 6,759,968 | B2 | 7/2004 | Zierolf | |
| 6,915,848 | B2 | 7/2005 | Thomeer et al. | |
| 6,929,070 | B2 | 8/2005 | Fu et al. | |
| 7,066,284 | B2 * | 6/2006 | Wylie et al. | 175/65 |
| 2002/0158120 | A1 | 10/2002 | Zierolf | |
| 2003/0042016 | A1 | 3/2003 | Vinegar et al. | |
| 2004/0212510 | A1 * | 10/2004 | Aronstam | 340/606 |
| 2004/0222084 | A1 * | 11/2004 | Wigg et al. | 204/196.06 |

OTHER PUBLICATIONS

"EmbedSense Wireless Sensor"; MicroStrain; http:www.microstrain.com/embed_sense.htm; 3 pages. (Undated but admitted prior art).

"FAQs"; in-depth; wellboreDNA.com; http://welboredna.com/faqs.html; 3 pages. (Undated but admitted prior art).

"Product & Technology Lab"; in-depth; wellboreDNA.com; http://www.wellboredna.com/tech.html; 2 pages. (Undated but admitted prior art).

* cited by examiner

DOWNHOLE TOOL SYSTEM AND METHOD FOR USE OF SAME

CROSS-REFERENCE TO RELATED APPLICATIONS

This is a continuation application of co-pending application Ser. No. 10/841,780, entitled System and Method for Monitoring Erosion, filed on May 7, 2004.

TECHNICAL FIELD OF THE INVENTION

This invention relates, in general, to monitoring erosion in a downhole tool system and, in particular, to use of a sensor that is interrogated downhole to determine the erosive effects caused by flowing fluids containing formation sand, gravel, proppants or other erosive agents through downhole tools.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulates. For example, the particulates cause abrasive wear to components within the well, such as joints, chokes, flowlines, tubulars, pumps and valves as well as any components having directional flow changes. In addition, the particulates may partially or fully clog the well creating the need for an expensive workover. Also, if the particulate matter is produced to the surface, it must be removed from the hydrocarbon fluids using surface processing equipment.

One method for preventing the production of such particulate material to the surface is gravel packing the well adjacent the unconsolidated or loosely consolidated production interval. In a typical gravel pack completion, a sand control screen is lowered into the wellbore on a workstring to a position proximate the desired production interval. A fluid slurry including a liquid carrier and a relatively coarse particulate material, which is typically sized and graded and which is referred to herein as gravel, is then pumped down the workstring and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

It is sometimes desirable to perform a formation fracturing and propping operation prior to or simultaneously with the gravel packing operation. Hydraulic fracturing of a hydrocarbon formation is sometimes desirable to increase the permeability of the production interval adjacent the wellbore. According to conventional practice, a fracture fluid such as water, oil, oil/water emulsion, gelled water, gelled oil or foam is pumped down the workstring with sufficient pressure to open multiple fractures in the production interval. The fracture fluid may carry a suitable propping agent, such as sand or gravel, which is referred to herein as a proppant, into the fractures for the purpose of holding the fractures open following the fracturing operation.

The fracture fluid must be forced into the formation at a flow rate great enough to fracture the formation allowing the entrained proppant to enter the fractures and prop the formation structures apart, producing channels which will create highly conductive paths reaching out into the production interval, and thereby increasing the reservoir permeability in the fracture region. As such, the success of the fracture operation is dependent upon the ability to inject large volumes of hydraulic fracture fluid into the surrounding formation at a high pressure and at a high flow rate.

For most hydrocarbon formations, a successful fracture and propping operation will require injection flow rates that are much higher than those required for gravel packing. For example, in typical gravel packing, a single pump capable of delivering one to ten barrels per minute may be sufficient. On the other hand, for a successful fracturing operation, three or four large capacity pumps may be required in order to pump at rates higher than the formation fracture gradient which may range up to 60 barrels per minute or more.

It has been found, however, that the high injection flow rates that are associated with fracturing operations and, to a lesser extent, the particulate matter associated with both gravel and fracturing operations cause erosion to the surfaces of downhole components. For example, the surfaces of the cross-over assembly used during these treatment operations are particularly susceptible to erosion. In order to monitor the wear threshold of downhole equipment, erosion detection systems have been utilized that typically include a series of pressure gauges that monitor pressure changes by measuring pressure at a corresponding series of locations. In these existing solutions, a loss in pressure is a possible indication of a failure of an eroded component.

Hence, the existing solutions are reactive schemes that provide only for a possible detection of failed components. Therefore, a need has arisen for a system and method for monitoring erosion and the structural integrity and health of surfaces subject to erosion and wear. A need has also arisen for such a system and method to monitor the early stages of erosion in downhole components, downhole tubulars, flowlines and surface equipment. Further, a need exists for a proactive approach to monitoring erosion that provides for preventative maintenance of equipment, alterations in treatment or production parameters and minimizes the likelihood of failures caused by erosion.

SUMMARY OF THE INVENTION

The present invention disclosed herein provides a system and method for monitoring erosion and the structural integrity and health of surfaces subject to erosion and wear. The system and method of the present invention provide detection in the early stages of erosion in downhole components, downhole tubulars, flowlines and surface equipment. The system and method of the present invention achieve these results by monitoring erosion sensors embedded within downhole tools, downhole tubulars, flow lines, surface equipment and the like during completion and production operations such that a proactive approach to monitoring erosion is provided for preventative maintenance of equipment, alterations in treatment or production parameters and minimizing the likelihood of failures caused by erosion.

In one aspect, the present invention is directed to a downhole tool system the includes a downhole tool that is operably positionable within a wellbore. A sensor is positioned within the downhole tool. The sensor has a first mode in which the sensor is responsive to RF interrogation and a second mode in which the sensor is not responsive to RF interrogation. The sensor is operable to transition from the first mode to the second mode upon the occurrence of a predetermined level of erosion of the downhole tool proximate the sensor. A detector is operably positionable relative to the downhole tool in communicative proximity to the sensor. The detector interrogates the sensor to determine whether the predetermined level of erosion has occurred.

In one embodiment, the system includes a database for recording erosion condition data obtained by the detector. In certain embodiments, the sensor may be a radio frequency identification component. In other embodiments, the sensor may include an antenna. In any of these embodiments, the erosion may be caused by a moving fluid that may contain erosive agents such as formation sand or treatment additives such as gravel or proppants.

In another aspect, the present invention is directed to a downhole tool system the includes a downhole tool that is operably positionable within a wellbore. A plurality of sensors are embedded within the downhole tool. Each of the sensors has a first mode in which the sensors are responsive to RF interrogation and a second mode in which the sensors are not responsive. The sensors are operable to transition from the first mode to the second mode upon the occurrence of a predetermined level of erosion of the downhole tool proximate the respective sensors. A detector is operably positionable relative to the downhole tool in communicative proximity to the sensors. The detector interrogates the sensors to determine whether the predetermined level of erosion has occurred and if so, the location of the predetermined level of erosion based upon which of the sensors are not responsive. In one embodiment, each of the sensors is associated with a unique identifier that is utilized in determining the location of the predetermined level of erosion.

In a further aspect, the present invention is directed to a downhole method that includes disposing a downhole tool within a wellbore, the downhole tool having a sensor positioned therein, the sensor having a first mode in which the sensor is responsive to RF interrogation and a second mode in which the sensor is not responsive to RF interrogation, the sensor operable to transition from the first mode to the second mode upon the occurrence of a predetermined level of erosion of a surface of the downhole tool. The method also includes flowing a fluid through the downhole tool, running a detector into the wellbore such that the detector is in communicative proximity to the sensor, interrogating the sensor with the detector and determining whether a predetermined level of erosion of the downhole tool has occurred based upon the responsiveness of the sensor. In the method, a plurality of sensors may be embedded along a length of the downhole and substantially equidistant from the surface or such that at least some of the sensors are positioned at different distances from the surface. In either case, the interrogating may involve interrogation of each of the sensors with the detector.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
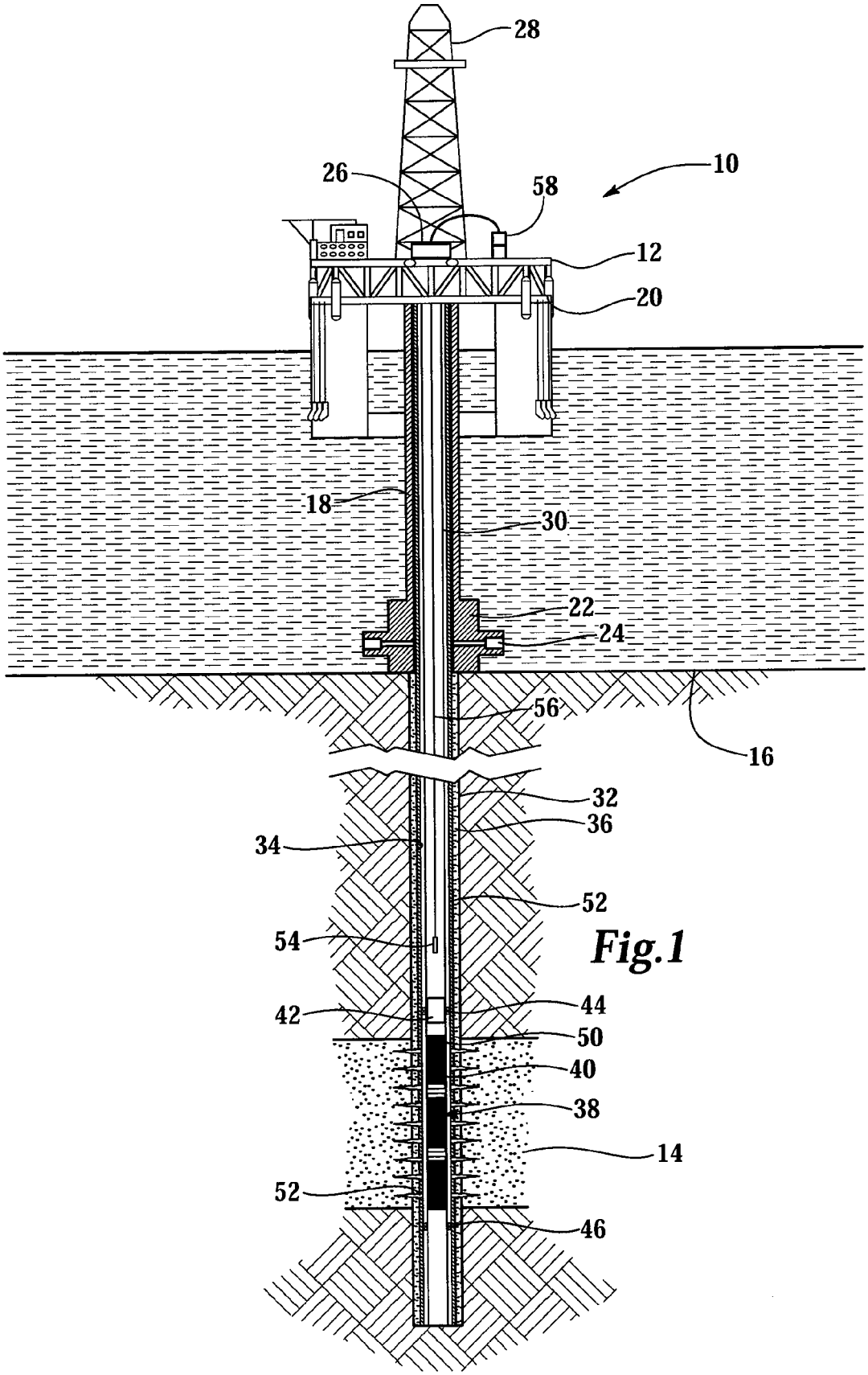
FIG. 1 is a schematic illustration of an offshore oil and gas platform following a fracture packing operation wherein a system for monitoring for erosion according to the present invention is being utilized.

Referring initially to FIG. 1, a system for monitoring erosion of a downhole tool operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as workstring 30.

A wellbore 32 extends through the various earth strata including formation 14. A casing 34 is cemented within wellbore 32 by cement 36. Workstring 30 includes various tools for completing the well. On the lower end of workstring 30 is a fracture packing assembly 38 that includes sand control screens 40 and cross-over assembly 42 that are positioned adjacent to formation 14 between packers 44, 46 in annular region or interval 50 that includes perforations 52. When it is desired to fracture pack formation 14, a fluid slurry including a liquid carrier and proppants is pumped down workstring 30. The fracture fluid exits workstring 30 though cross-over assembly 42 into annular interval 50 and is forced at a high flow rate through perforations 52 into formation 14. The fracture fluid tends to fracture or part the rock to form fissures extending deep into formation 14. As more rock is fractured, the void space surface area increases in formation 14. The fracture operation continues until an equilibrium is reached where the amount of fluid introduced into formation 14 approximates the amount of fluid leaking off into the rock, whereby the fractures stop propagating. The proppant material in the fracture fluid fills the voids and maintains the voids in an open position for production.

Once the fracture treatment is complete, the gravel packing portion of the fracture operation may commence. The fluid slurry is injected into annular interval 50 between screen assembly 38 and wellbore 32 through cross-over assembly 42 as before. During the gravel packing operation, a surface valve is operated from the closed to the open position allowing the gravel portion of the fluid slurry to be deposited in annular interval 50 while the fluid carrier enters sand control screens 40. More specifically, sand control screens 40 disallow further migration of the gravel in the fluid slurry but allow the liquid carrier to travel therethrough and up to the surface in a known manner, such as through a wash pipe and into the annular region above packer 44.

As illustrated, a detector 54 is coupled to a conveyance 56 such as a wireline, a slickline, an electric line or the like and run downhole from a control unit 58 located on platform 12 to a position proximate cross-over assembly 42. Detector 54 may be utilized in wellbore 32 before, after or during the treatment operation. As will be described in further detail hereinbelow, an array of sensors is embedded within components of the downhole tools, such as cross-over assembly 42, to monitor erosion. Each sensor of the array of sensors has a first mode in which the sensor is responsive to RF interrogation generated by detector 54 and a second mode in which the sensor is non-responsive to RF interrogation. Each sensor of the array of sensors transitions from the first mode to the second mode to indicate that a predetermined level of erosion is present. Erosion may be caused by an erosive agent such as fluids containing particulate matter including sand, gravel, proppants or the like present in treatment fluids, production fluids and the like. As used herein, an erosive agent is any material that wears away at the surface of a substrate by continuous abrasive action typically accompanied by high fluid velocity. Moreover, as previously discussed, the high injection flow rates associated with fracturing operations accelerate the erosion of the surfaces of the components of downhole tools and, in particular, at regions where the direction of the fluid flow is altered such as at cross-over assembly 42. In order to monitor the erosion, detector 54 is positioned in communicative proximity to each sensor in order to interrogate each sensor. If the sensor responds, a predetermined level of erosion has not occurred. On the other hand, if the sensor is non-responsive, a predetermined level of erosion has occurred rendering the sensor disabled and thereby non-responsive. It should be appreciated that the erosive agent not only wears away the substrate but the sensor too. Specifically, once the surface behind which the sensor is positioned is eroded, the sensor is subjected to erosion and eventually disabled by the abrasive action of the erosive agent.

Even though FIG. 1 depicts a vertical well, it should be noted by one skilled in the art that the system for monitoring erosion of the present invention is equally well-suited for use in deviated wells, inclined wells or horizontal wells. In addition, it should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be noted by one skilled in the art that the systems and methods described herein may be utilized in onshore operations.

Figure 2A:
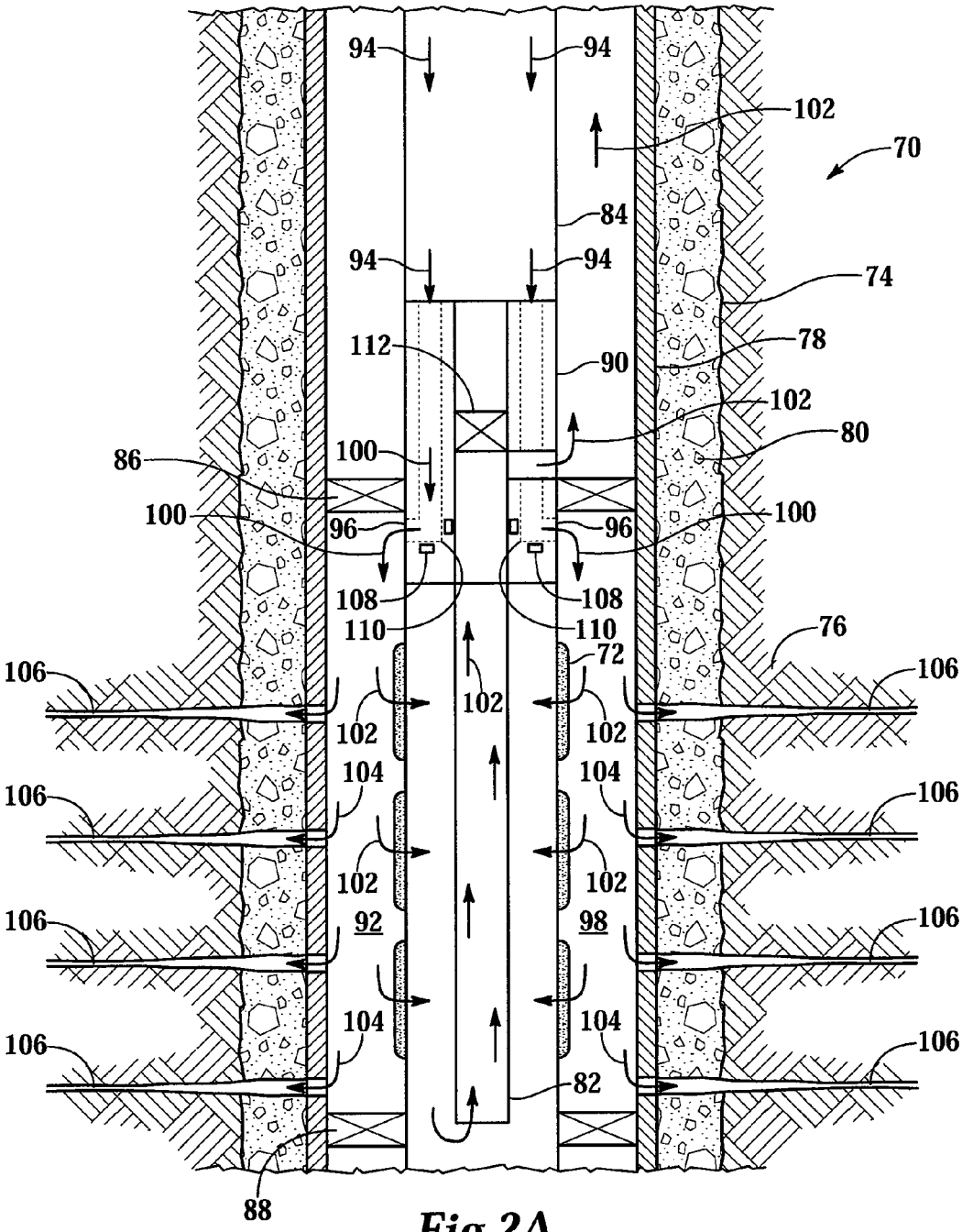
FIG. 2A is a half-sectional view of a sand control screen assembly and a cross-over assembly during a fracture packing operation.

FIG. 2A depicts a fracture packing operation 70 wherein the system for monitoring erosion according to the present invention may be utilized. In the illustrated embodiment, a sand control screen assembly 72 including a plurality of sand control screens is placed in a wellbore 74 proximate formation 76. Wellbore 74 includes a casing 78 that is secured therein by cement 80. Sand control screen assembly 72 and a wash pipe 82 are connected to a tool string 84 that includes a gravel packer 86, a sump packer 88 and a cross-over assembly 90.

To begin the completion, an interval 92 adjacent formation 76 is isolated by operating gravel packer 86 and sump packer 88 into sealing engagement with casing 78. Cross-over assembly 90 is located at the top of sand control screen assembly 72 and traverses gravel packer 86. During the fracture treatment, a frac fluid is first pumped into tool string 84 and through cross-over assembly 90 along the path illustrated by arrows 94. The frac fluid passes through cross-over ports 96 below gravel packer 86 into the annular area 98 between sand control screen assembly 72 and casing 78 as depicted by arrows 100.

Initially, the fracture operation takes place in a closed system where no fluid returns are taken to the surface. Although fluid from the frac pack flows through sand control screen assembly 72 and toward the surface via washpipe 82, as depicted by arrows 102, a valve positioned at or near the surface prevents fluids from flowing to the surface. As illustrated by arrows 104, the frac fluid, typically viscous gel mixed with proppants, is forced through the perforations that extend through casing 78 and cement 80 and into formation 76. The frac fluid tends to fracture or part the rock to form open void spaces in formation 76 depicted as fissures 106. As more rock is fractured, the void space surface area increases in formation 76. The larger the void space surface area, the more the carrier liquid in the frac fluid leaks off into formation 76 until an equilibrium is reached where the amount of fluid introduced into formation 76 approximates the amount of fluid leaking off into the rock, whereby the fractures stop propagating. If equilibrium is not reached, fracture propagation can also be stopped as proppant reaches the tips of fissures 106.

As previously discussed, the high flow rates associated with the fracture operation can cause erosion to the surfaces through which the fracture fluids flow. Sensors 108 are positioned at transition zones 110 of cross-over assembly 90 to monitor erosion at these particular erosion vulnerable locations. As will be described in further detail hereinbelow, a valve 112 may be opened to permit a detector to be lowered into the cross-over assembly 90 so that sensors 108 may be interrogated to monitor for erosion.

Figure 2B:
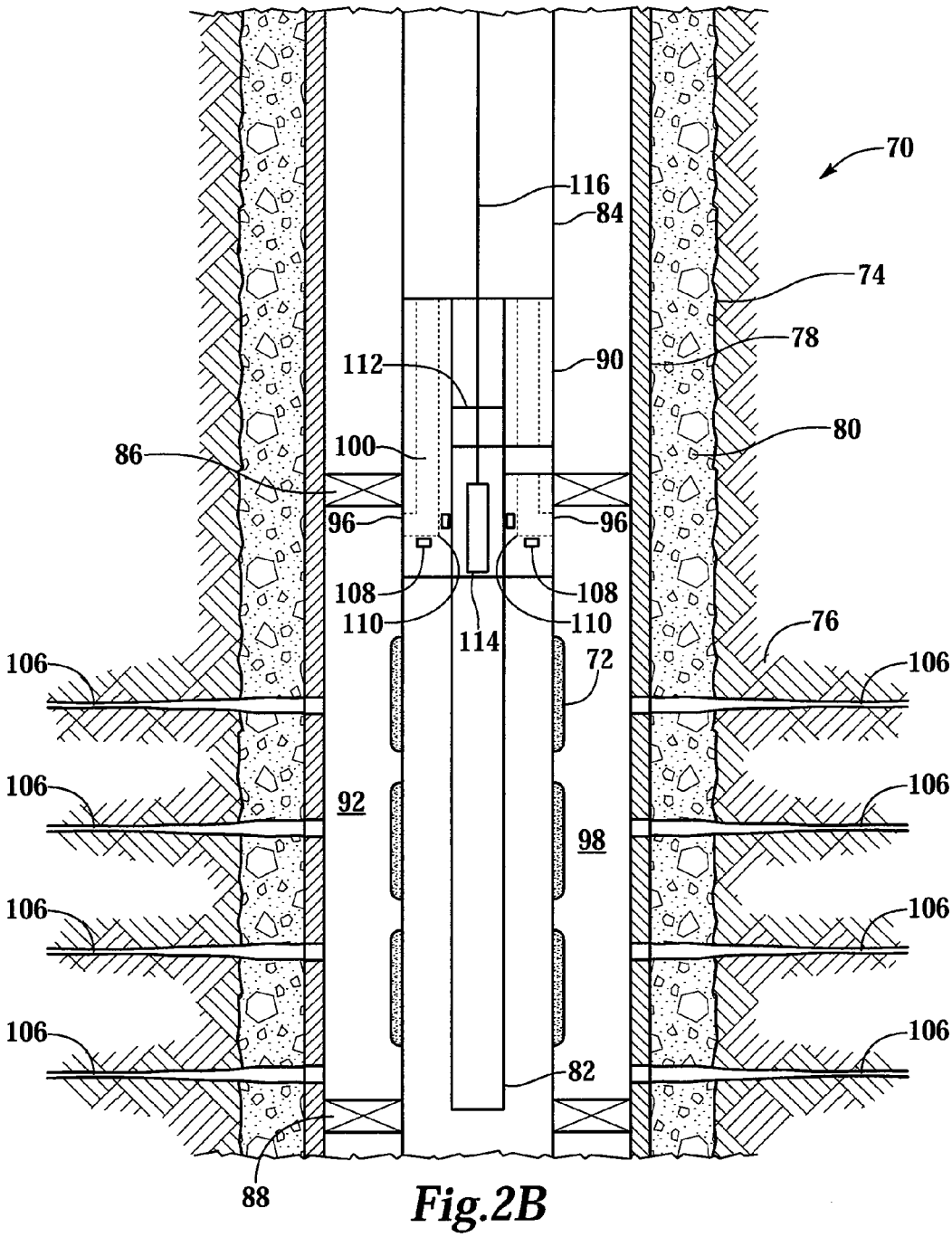
FIG. 2B is a half sectional view of the sand control screen assembly and the cross-over assembly following the fracture packing operation wherein the system for monitoring for erosion according to the present invention is being utilized.

FIG. 2B depicts fracture operation 70 at a point in the operation wherein frac fluid is not being pumped. For example, this may be at a time period between portions of the fracture operation or after the fracture operation has been completed. In the illustrated embodiment, a detector 114 is lowered on a conveyance 116 through valve 112, which is in the open position, into cross-over assembly 90. In particular, detector 114 is positioned in communicative proximity to sensors 108. Detector 114 interrogates each of the sensors 108 with a radio frequency or RF signal. If a given sensor responds, a predetermined level of erosion has not occurred in the material surrounding the sensor. On the other hand, if a given sensor is non-responsive, a predetermined level of erosion has occurred in the material surrounding the sensor rendering that sensor disabled and thereby non-responsive. Each sensor 108 returns a unique identifier such as a unique frequency so that detector 114 may discriminate between sensors 108. Accordingly, the location or locations of any erosion can be precisely and accurately monitored throughout the tools and tubulars of a completion or production string.

Figure 3:
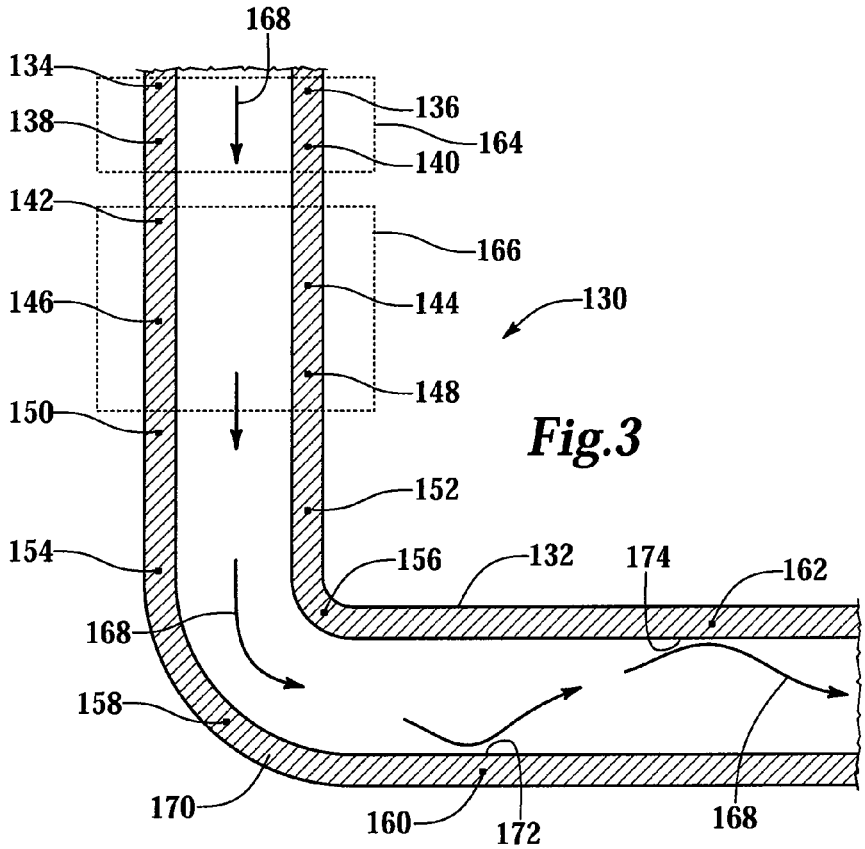
FIG. 3 is a cross-sectional view of a substrate in the form of a tubular having a transition area wherein an array of sensors is positioned according to the present invention.

FIG. 3 depicts a substrate 130 in the form of a tubular 132 for transporting fluids. Sensors, such as sensors 134-162, are embedded within tubular 132 at different locations in order to monitor erosion. These sensors 132-162 may be arranged in a variety of arrays. Sensors 134, 136, 138, 140 are positioned in a symmetrical and complimentary relationship as highlighted by box 164. In particular, sensor 134 is positioned across from sensor 136 and sensor 138 is positioned across from sensor 140. It should be appreciated by those skilled in the art that other types of array arrangements are within the teachings of the present invention. For example, sensors 142, 144, 146 and 148 are positioned in a staggered relationship as highlighted by box 166.

Regardless of the particular arrangement of sensors 134-162, in a preferred embodiment, the sensors are embedded within substrate 130 at regions which are particularly susceptible to erosion. As illustrated, erosive agents such as particles in the fluid flow through tubular 132 along the path indicated by arrows 168. As the fluid moves through a transition area 170 of tubular 132, the flow path becomes nonlinear and the erosive agents contact tubular 132 at erosion zones 172, 174. Sensors 160, 162 are embedded within tubular 132 at erosion zones 172, 174, respectively, in order to monitor the erosion at these particularly susceptible locations. In operation, a detector can identify the particular sensors in the array and the particular erosion conditions associated with the sensors. The detector may record each of the erosion conditions in a database to maintain an erosion history, for example, that may be utilized to determine the health of erosion zones 172, 174.

Figure 4A:
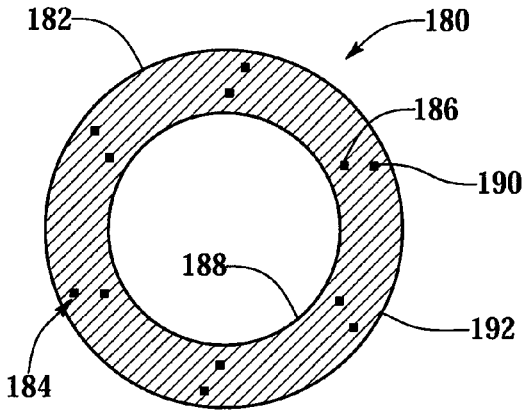
FIG. 4A is a cross-sectional view of another substrate in the form of a tubular wherein an array of sensors is positioned according to the present invention.

FIG. 4A depicts another embodiment of a substrate 180 in the form of a tubular 182 having an array of sensors 184 therein. In the illustrated embodiment, array of sensors 184 includes a sensor 186 positioned at a first distance from an inner surface 188 of tubular 182 and a second sensor 190 positioned at a second distance from inner surface 188. As will be appreciated, this arrangement of sensors at different depths is present throughout array of sensors 184. Positioning sensors at different depths enhances the ability to monitor erosion. For example, sensors 186, 190 each have a responsive mode and a non-responsive mode and each of the sensors 186, 190 transitions from the responsive mode to the non-responsive mode to indicate respective levels of erosion. Thus, by monitoring sensors 186, 190 two predetermined levels of erosion may be monitored.

As one skilled in the art will appreciate, the installation of the sensors may be accomplished using a variety of techniques. For example, holes may be drilled into outer surface 192 of substrate 180 such that sensors 184 may be positioned therein. It should be appreciated that due to the small size of the sensors, the holes do not have to be large. Preferably, the holes are formed from outer surface 192 and not from inner surface 180, which is the surface exposed to the erosion. After installation of the sensors, the holes may be capped with a filler material such as an epoxy, a threaded plug, a weld or the like.

The small form factor of the sensors permits the sensors to be employed in a wide variety of downhole and fluid transport related applications. The sensors may be employed in downhole tools, downhole tubulars, flow lines, surface equipment and the like during completion and production operations, for example. In this regard, the substrate may be a pipeline or other fluid transmission line, a riser, a drill bit, an elbow, a joint, a packer, a valve, a piston, a cylinder, a choke, a mandrel, a riser pipe, a liner, a landing nipple, a ported sub, a polished bore receptacle or the like. Moreover, it should be appreciated that the use of the sensors is not limited to downhole applications. As will be explained in further detail hereinbelow, the sensors of the present invention are well suited for flow lines that transport fluids on the surface. Further, the sensors are well suited for use with nonmetallic substrates, such as polymeric and elastomeric materials as well as composite materials. For example, sensors may be integrated into a layer of braided or filament wound material that forms a layered strip within a composite coiled tubing.

Figure 4B:
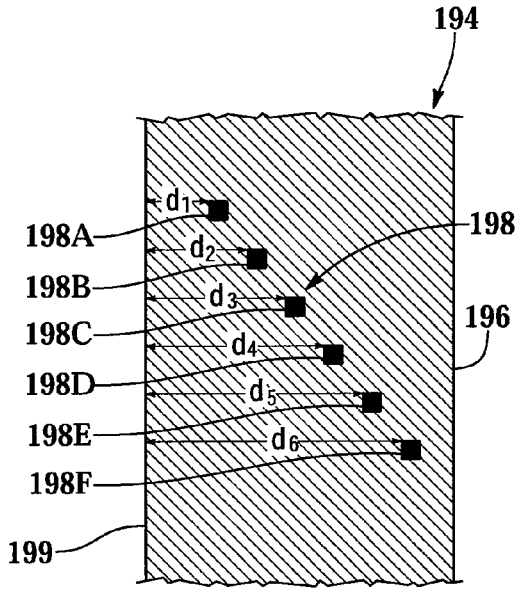
FIG. 4B is a cross-sectional view of a further substrate wherein an array of sensors is positioned according to the present invention.

FIG. 4B depicts another embodiment of a substrate 194 in the form of a section of tubular 196 having an array of sensors 198 positioned therein. In the illustrated embodiment, array of sensors 198 includes sensors 198A-198F, which are each placed at consecutively greater distances from surface 199 as expressed by the distance indicators $d_1$-$d_6$ having the following relationship: $d_1<d_2<d_3<d_4<d_5<d_6$. For example, sensor 198A is positioned at a distance $d_1$ from surface 199, sensor 198B is positioned at a distance $d_2$ from surface 199 and sensor 198C is positioned at a distance $d_3$ from surface 199. Positioning sensors at various depths enhances the ability to monitor erosion in a discrete manner. In operation, sensors 198A-198F each have a responsive mode and a non-responsive mode such that each of the sensors 198A-198F transition from the responsive mode to the non-responsive mode to indicate respective specific levels of erosion. Thus, by monitoring the array of sensors 198, discrete levels of erosion may be monitored.

Figure 5:
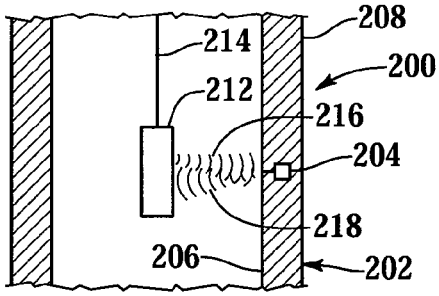
FIG. 5 is a half sectional view of a system for monitoring erosion at a first time.

FIG. 5 depicts a system 200 for monitoring erosion. A substrate 202 includes a sensor 204 embedded therein for monitoring erosion. Sensor 204 is discreetly positioned within substrate 202 such that sensor 204 does not affect the structural integrity of substrate 202. Substrate 202 is defined by an inner surface 206 and an outer surface 208. Inner surface 206 is subjectable to fluid flow and, although no erosion has occurred, inner surface 206 is a candidate for erosion. A detector 212 is lowered on a wireline 214 and positioned in communicative proximity to the sensor 204 within substrate 202 such that detector 212 is closer to inner surface 206 than outer surface 208. Detector 212 probes sensor 204 and determines whether the predetermined level of erosion of inner surface 206 of substrate 202 has occurred based upon the responsiveness of sensor 204. As illustrated, detector 212 transmits RF interrogating signal 216 which is received by sensor 204. Sensor 204, in turn, responds with RF response signal 218, which is received by detector 212. Based on the responsiveness of sensor 204, detector 212 determines that the predetermined level of erosion has not occurred to surface 206.

Figure 6:
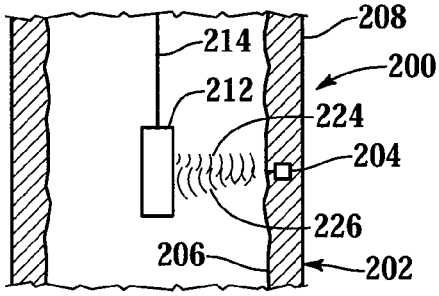
FIG. 6 is a half sectional view of the system for monitoring erosion at a second time.

FIG. 6 depicts the system 200 for monitoring erosion at a second time. Inner surface 206 of substrate 202 has been subjected to an erosive agent for some period of time and inner surface 206 has eroded. The erosion, however, has not reached a predetermined level. Specifically, sensor 204 remains operational although a portion of the sensor's antenna has been eroded along with inner surface 206. Detector 212 interrogates sensor 204 with RF signal 224 and sensor 204 responds with RF signal 226. Based on the responsiveness of sensor 204, detector 212 determines that the predetermined level of erosion has not been reached.

Figure 7:
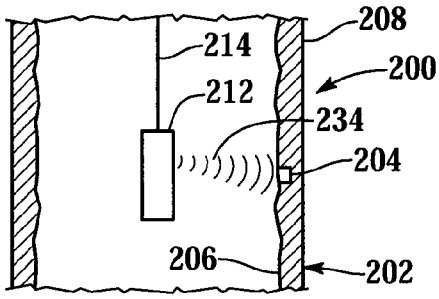
FIG. 7 is a half sectional view of the system for monitoring erosion at a third time.

FIG. 7 depicts system 200 for monitoring erosion at a third time wherein further fluid flow has eroded inner surface 206 of substrate 202 to the point that the predetermined level of erosion has occurred. Specifically, the erosion has disabled sensor 204 and provided the impetus for the transition from the first mode to the second mode of sensor 204. In the illustrated embodiment, detector 212 interrogates sensor 204 with RF signal 234. Since sensor 204 is disabled, however, sensor 204 does not respond to RF signal 234. Based upon the non-responsiveness of sensor 204, detector 212 determines that the predetermined level of erosion has occurred to inner surface 206 of substrate 202. Based on the information that a predetermined level of erosion has occurred, preventative maintenance or other corrective action may be undertaken to ensure the health of substrate 202 before substrate 202 fails.

Accordingly, it should be appreciated that the present invention provides a system and method for monitoring erosion and the structural integrity and health of surfaces subject to erosion and wear. In particular, the passive sensors of the present invention, provide an indication of a predetermined level of erosion. Hence, the systems and methods of the present invention provide for the proactive monitoring of erosion which represents an improvement over existing reactive schemes.

Figure 8:
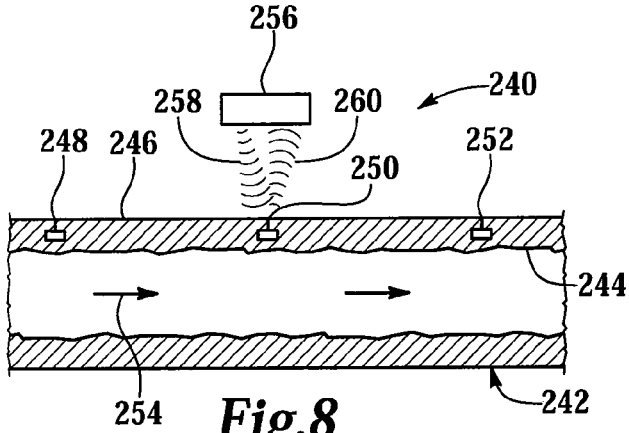
FIG. 8 is a half sectional view of an alternate embodiment of a system for monitoring erosion.

FIG. 8 depicts an alternate embodiment of a system 240 for monitoring erosion. A substrate 242 includes an inner surface 244 and an outer surface 246. Substrate 242 may be a flow line positioned on the surface carrying production fluids that requires monitoring for erosion while being used. It should be appreciated that production fluids may carry particulate matter, such as sand, that may cause erosion.

Sensors 248, 250, 252 are embedded within substrate 242 in order to monitor erosion of inner surface 244. Fluid flow contacts inner surface 244 as it flows along the path represented by arrows 254. As illustrated, detector 256 is positioned within communicative proximity of sensor 250 in order to interrogate sensor 250 and determine if a predetermined level of erosion has occurred. Further, detector 256 is positioned closer to outer surface 246 than inner surface 244. The receded and jagged inner surface 244 indicates that some level of erosion has occurred, however, the erosion has not disabled sensor 250. Detector 256 transmits RF signal 258 to sensor 250, which responds with response 260 as sensor 250 is in a first mode of operation since the predetermined level of erosion has not occurred. It should be appreciated that in operation, detector 256 may move from sensor 248 to sensor 250 to sensor 252 to develop a picture of the health and structural integrity of substrate 242 while substrate is carrying fluid or another erosive agent.

Figure 9:
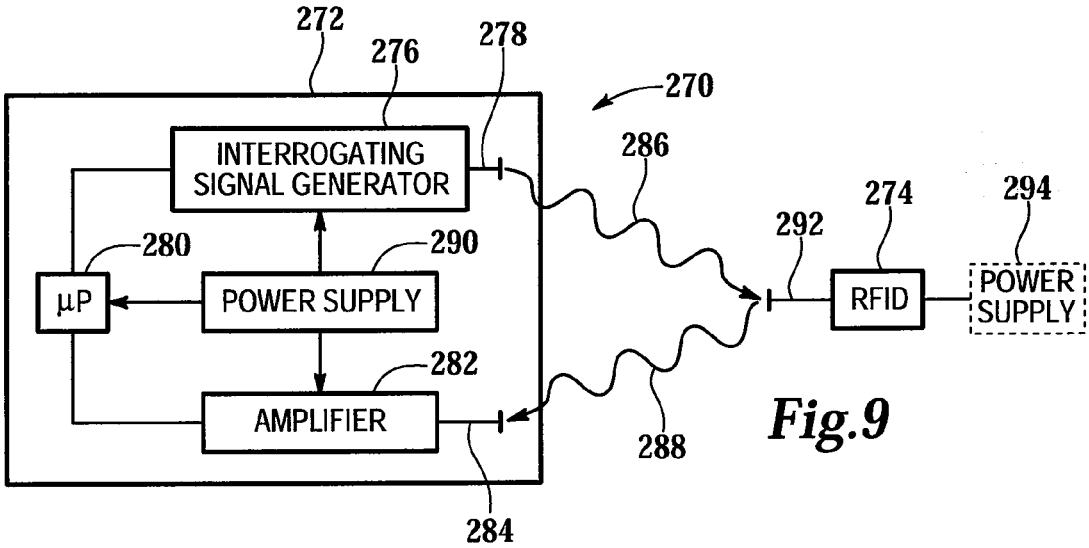
FIG. 9 is a block diagram of a detector communicating with a sensor according to the present invention.

FIG. 9 depicts a system 270 wherein detector 272 is communicating with a sensor 274 according to the teachings of the present invention. Specifically, detector 272 and sensor 274 are positioned within communicative proximity of one another. Detector 272 comprises an interrogating signal generator 276 with a sending transducer or antenna 278. A microprocessor 280 is connected to the interrogating signal generator 276 and an amplifier 282, which, in turn, is connected to a signal receiving transducer or an antenna 284. In one embodiment, amplifier 282 includes a demodulator that demodulates the unique RF signal received from the sensor 274.

Microprocessor 280 includes an electronic circuit which performs the necessary arithmetic, logic and control operations with the assistance of internal memory. It should be appreciated, however, that the processing power for detector 272 may be provided by any combination of hardware, firmware and software. Moreover, in an alternate embodiment, detector 272 does not include sophisticated circuitry and memory for storing data, but rather relays the collected data to the surface in real time.

As can be seen from FIG. 9, power source 290 powers interrogating signal generator 276 to send interrogating signal 286 from antenna 278. Additionally, power source 290 supplies power to microprocessor 280 and amplifier 282 which receives RF response 288 from sensor 274. Preferably, power source 290 comprises a battery to enable these operations. Sensor 274 is illustrated as a RFID component that includes a signal receiving and reflecting antenna 292. In one embodiment, the RFID component includes a reflector modulator for modulating interrogating signal 286 received by antenna 292 as well as for reflecting the modulated signal, response signal 288, from antenna 292. In another embodiment, the antenna 292 is integrated with RFID 274 as an embedded antenna.

By modulating RF signal 286, sensor 274 transmits to detector 272 a unique identifier that allows detector 272 to distinguish sensor 274 from other similar sensors. As previously discussed, this feature is particularly useful in the context of an array of sensors that are positioned throughout a substrate. In one implementation, antenna 292 may be constructed of any suitable electrically conductive material such as a suitable nickel-based alloy. As previously discussed, antenna 292 increased the transmission power of sensor 292. This is particularly useful when sensor 274 is embedded within a metallic substrate. Preferably, antenna 292 erodes at approximately the same rate as the host substrate erodes such that when antenna 292 is completely eroded, sensor 274 is disabled and non-responsive to indicate that a predetermined level of erosion has occurred.

Preferably, sensor 274 is a passive device that requires no battery. Passive devices do not require an additional power source as the energy received from the transmission provides sufficient power for the sensor to respond with a weak or periodic reply transmission as along as sensor 274 is receiving the appropriate interrogation signal. It should be appreciated, however, that sensor 274 may be an active device that receives power from a power supply, such as optional power supply 294.

In operation, interrogating signal 286 and response signal 288 are typically RF signals produced by the RF transmitter circuits described hereinabove. Interrogating signal 286 from antenna 278 passes through air or a fluid medium, for example, and is received by antenna 292 at sensor 274. In one embodiment, the modulator component of sensor 274 modulates the signal to uniquely identify sensor 274 and reflects the amplitude-modulated signal, response signal 288, from antenna 292 to antenna 284. Antenna 284 sends the signal to amplifier 282 which processes the signal and forwards the signal to microprocessor 280 for further processing, wherein the system determines that a predetermined level of erosion has not occurred. In the alternative, if sensor 274 has been disabled by erosion then signal 288 is not transmitted. When sensor 274 is in this second operation mode, after a predetermined period of time in which antenna 284 does not receive a signal, microprocessor 280 determines that the predetermined level of erosion is present in the substrate.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A downhole tool system comprising:

a downhole tool operably positionable within a wellbore;

a sensor positioned within the downhole tool, the sensor having a first mode and a second mode, in the first mode, the sensor is responsive to RF interrogation, in the second mode, the sensor is not responsive to RF interrogation, the sensor operable to transition from the first mode to the second mode upon the occurrence of a predetermined level of erosion of the downhole tool proximate the sensor; and a detector operably positionable relative to the downhole tool in communicative proximity to the sensor, wherein the detector interrogates the sensor to determine whether the predetermined level of erosion has occurred.

2. The system as recited in claim 1 further comprising a database for recording erosion condition data obtained by the detector.

3. The system as recited in claim 1 wherein the erosion is caused by a moving fluid.

4. The system as recited in claim 1 wherein the erosion is caused by an erosive agent.

5. The system as recited in claim 1 wherein the sensor further comprises a radio frequency identification component.

6. The system as recited in claim 1 wherein the sensor further comprises an antenna.

7. A downhole tool system comprising:

a downhole tool operably positionable within a wellbore;

a plurality of sensors embedded within the downhole tool, each of the sensors having a first mode and a second mode, in the first mode, the sensors are responsive to RF interrogation, in the second mode, the sensors are not responsive, the sensors are operable to transition from the first mode to the second mode upon the occurrence of a predetermined level of erosion of the downhole tool proximate the respective sensors; and a detector operably positionable relative to the downhole tool in communicative proximity to the sensors, wherein the detector interrogates the sensors to determine whether the predetermined level of erosion has occurred and if so, the location of the predetermined level of erosion based upon which of the sensors are not responsive.

8. The system as recited in claim 7 wherein the erosion is caused by a moving fluid.

9. The system as recited in claim 7 wherein the erosion is caused by an erosive agent.

10. The system as recited in claim 7 wherein each of the sensors further comprises a radio frequency identification component.

11. The system as recited in claim 7 wherein each of the sensors is associated with a unique identifier.

12. The system as recited in claim 7 wherein each of the sensors is associated with a unique identifier that is utilized in determining the location of the predetermined level of erosion.

13. The system as recited in claim 7 wherein each of the sensors further comprises an antenna.

14. A downhole method comprising the steps of:

disposing a downhole tool within a wellbore, the downhole tool having a sensor positioned therein, the sensor having a first mode in which the sensor is responsive to RF interrogation and a second mode in which the sensor is not responsive to RF interrogation, the sensor operable to transition from the first mode to the second mode upon the occurrence of a predetermined level of erosion of a surface of the downhole tool;

flowing a fluid through the downhole tool;

after flowing the fluid through the downhole tool, running a detector into the wellbore such that the detector is in communicative proximity to the sensor;

interrogating the sensor with the detector; and determining whether a predetermined level of erosion of the downhole tool has occurred based upon the responsiveness of the sensor.

15. The method as recited in claim 14 wherein the step of interrogating the sensor further comprises interrogating a radio frequency identification component.

16. The method as recited in claim 15 wherein the step of interrogating the radio frequency identification component further comprises receiving a unique identifier of the radio frequency identification component at the detector.

17. The method as recited in claim 15 wherein the step of interrogating the radio frequency identification component further comprises receiving no response from the radio frequency identification component at the detector.

18. The method as recited in claim 14 further comprising a plurality of sensors embedded along a length of the downhole and substantially equidistant from the surface and wherein the step of interrogating the sensor with the detector further comprises interrogating each of the sensors with the detector.

19. The method as recited in claim 14 further comprising an array of sensors embedded within the downhole tool, at least some of the sensors positioned at different distances from the surface and wherein the step of interrogating the sensor with the detector further comprises interrogating each of the sensors with the detector.

20. The method as recited in claim 14 further comprising retrieving the detector to the surface and storing erosion condition information obtained in the interrogating in a database.

* * * * *